US008598970B2

(12) United States Patent
Panariello et al.

(10) Patent No.: US 8,598,970 B2
(45) Date of Patent: Dec. 3, 2013

(54) DIELECTRIC RESONATOR HAVING A MOUNTING FLANGE ATTACHED AT THE BOTTOM END OF THE RESONATOR FOR THERMAL DISSIPATION

(75) Inventors: Antonio Panariello, Cambridge (CA); Ming Yu, Waterloo (CA); Mihai Vladimirescu, Cambridge (CA); William A. Fitzpatrick, Waterloo (CA)

(73) Assignee: Com Dev International Ltd., Cambridge (CA)

( * ) Notice: Subject to any disclaimer, the term of this patent is extended or adjusted under 35 U.S.C. 154(b) by 0 days.

(21) Appl. No.: 13/223,869

(22) Filed: Sep. 1, 2011

(65) Prior Publication Data

US 2011/0309900 A1 Dec. 22, 2011

Related U.S. Application Data

(62) Division of application No. 12/252,076, filed on Oct. 15, 2008, now Pat. No. 8,031,036.

(51) Int. Cl.
*H01P 7/10* (2006.01)

(52) U.S. Cl.
USPC ..... 333/219.1; 333/202

(58) Field of Classification Search
USPC ..... 333/202, 219.1, 235, 222
See application file for complete search history.

(56) References Cited

U.S. PATENT DOCUMENTS 4,318,064 A 3/1982 Kach
4,453,146 A 6/1984 Fiedziuszko
5,097,238 A * 3/1992 Sato et al. ..... 333/219.1
5,712,605 A * 1/1998 Flory et al. ..... 333/219.1
5,880,650 A 3/1999 Latouche et al.
6,002,311 A * 12/1999 Wey et al. ..... 333/219.1
6,320,484 B1 11/2001 Furuya
6,429,756 B1 8/2002 Kurisu et al.
6,535,087 B1 3/2003 Fitzpatrick et al.

(Continued)

FOREIGN PATENT DOCUMENTS

EP 0 173 545 3/1986
EP 0173545 A2 3/1986

(Continued)

OTHER PUBLICATIONS

Extended European Search Report for European Patent Application No. 10184905.7, dated Mar. 18, 2011.

(Continued)

*Primary Examiner* — Benny Lee
(74) *Attorney, Agent, or Firm* — Bereskin & Parr LLP; Isis E. Caulder

(57) ABSTRACT

A resonator cavity for supporting a plurality of resonant modes and filtering electromagnetic energy includes a cavity and a resonator element with a mounting flange. The cavity is defined by a top end wall, a bottom end wall and a sidewall and has a longitudinal axis along its length is defined. The resonator element is positioned within the cavity along the longitudinal axis and includes a mounting flange. The resonator element is only in physical contact with the cavity through the mounting flange at a mounting location and where at least one resonant mode of the electromagnetic energy exhibits a local minimum. The dimensions of the cavity and the resonator element are selected so that the associated electromagnetic energy is defined by an electromagnetic field pattern that substantially repeats itself at least twice along the length of the resonator.

18 Claims, 13 Drawing Sheets

(56) References Cited

U.S. PATENT DOCUMENTS

| | | | | |
|---|---|---|---|---|
| 8,031,036 | B2 * | 10/2011 | Panariello et al. | 333/219.1 |
| 2004/0051602 | A1 * | 3/2004 | Pance et al. | 333/202 |
| 2006/0097826 | A1 | 5/2006 | Srivastava et al. | |

FOREIGN PATENT DOCUMENTS

| | | | |
|---|---|---|---|
| EP | 1 104 044 | | 5/2001 |
| EP | 1104044 | A1 | 5/2001 |
| EP | 2178156 | | 4/2010 |
| JP | 56 165402 | | 12/1981 |
| JP | 56165402 | A | 12/1981 |
| WO | 9324970 | A1 | 12/1993 |
| WO | WO 93/24970 | | 12/1993 |
| WO | WO02/39535 | | 5/2002 |
| WO | 0239535 | A1 | 5/2005 |

OTHER PUBLICATIONS

Chi Wang et al. "Dielectric Resonators and Filters" IEEE Microwave Magazine p. 115 to 127, Oct. 2007.

European Search Report dated Jul. 3, 2009 for Application No. 09156511.9-2220.

Full European Search Report for Application No. 09156511.9-2220 dated Sep. 21, 2009.

European Office Action dated Mar. 14, 2011, corresponding to European Application No. 09156511.9-2220 filed Apr. 16, 2009.

European Search Report dated Mar. 18, 2011, corresponding to European Application No. 10184905.7-2220 filed Sep. 30, 2010.

* cited by examiner

DIELECTRIC RESONATOR HAVING A MOUNTING FLANGE ATTACHED AT THE BOTTOM END OF THE RESONATOR FOR THERMAL DISSIPATION

CROSS-REFERENCE TO RELATED APPLICATIONS

This application is a divisional of U.S. patent application Ser. No. 12/252,076, filed on Oct. 15, 2008, the entire contents of which are hereby incorporated by reference.

FIELD

The embodiments described herein relate generally to microwave band pass filters and more particularly to dielectric resonators and filters.

BACKGROUND

A microwave filter is an electromagnetic circuit that can be tuned to pass energy at a specified resonant frequency. Accordingly, microwave filters are commonly used in telecommunication applications to transmit energy in a desired band of frequencies (i.e. the passband) and to reject energy at unwanted frequencies (i.e. the stopband) that fall outside of the desired band. In addition, a microwave filter should preferably meet certain performance criteria such as insertion loss (i.e. the minimum loss in the passband), loss variation (i.e. the flatness of the insertion loss in the passband), rejection or isolation (the attenuation in the stopband), group delay (i.e. related to the phase characteristics of the filter) and return loss (i.e. related to the ratio from the reflected and incident power).

When the material type and the size of the resonators for the filter are chosen, the Q (i.e. quality) factor for the filter is set. The Q factor has a direct effect on the amount of insertion loss and pass-band flatness of the realized microwave filter. In particular, a filter having a higher Q factor will have a lower insertion loss and sharper slopes (i.e. a more "square" filter response) in the transition region between the passband and the stopband. In contrast, filters which have a low Q factor have a larger amount of energy dissipation due to larger insertion loss and will also exhibit a larger degradation in band edge sharpness. Examples of high Q factor filters include waveguide (hollow cavity) and dielectric resonator filters that have Q factors on the order of 8,000 to 15,000. An example of a low Q factor filter is a coaxial resonator filter that typically has a Q factor on the order of 2,000 to 5,000.

Dielectric material with high relative permittivity, or a high relative dielectric constant (i.e. typically a dielectric constant greater than 20) are widely used to form microwave/RF resonators and filters. Permittivity is a physical quantity that determines the ability of a material to polarize in response to an electromagnetic field, and thereby reduces the total electromagnetic field inside the material. Thus, permittivity relates to a material's ability to transmit (or "permit") an electromagnetic field.

Due to the fact that the materials of the various components are dielectric materials, they are very poor in conducting heat. Thus, in high power applications, the temperature of dielectric resonators can be very high, which can cause serious operational difficulties especially in a highly constrained mechanical design space.

SUMMARY OF THE INVENTION

The embodiments described herein provide in one aspect, a resonator cavity for supporting a plurality of resonant modes and filtering electromagnetic energy, said resonator cavity comprising:

(a) a cavity defined by a top end wall, a bottom end wall and a sidewall, said cavity having a longitudinal axis along which the length of the cavity is defined;

(b) a resonator element having a top end and a bottom end, said resonator element positioned within the cavity along the longitudinal axis of the cavity along which the length of the resonator body is also defined;

(c) the resonator element also including a mounting flange for coupling the resonator element to the cavity at a mounting location along the length of the resonator element;

(d) the cavity and the resonator element having dimensions selected so that the electromagnetic energy associated with the resonator cavity is defined by an electromagnetic field pattern that substantially repeats itself at least twice along the length of the resonator; and wherein the resonator element is only in physical contact with the cavity through the mounting flange at the mounting location where at least one resonant mode of the electromagnetic energy exhibits a local minima.

Further aspects and advantages of the embodiments described herein will appear from the following description taken together with the accompanying drawings.

BRIEF DESCRIPTION OF THE DRAWINGS

For a better understanding of the embodiments described herein and to show more clearly how they may be carried into effect, reference will now be made, by way of example only, to the accompanying drawings which show at least one exemplary embodiment, and in which.

Figure 1:
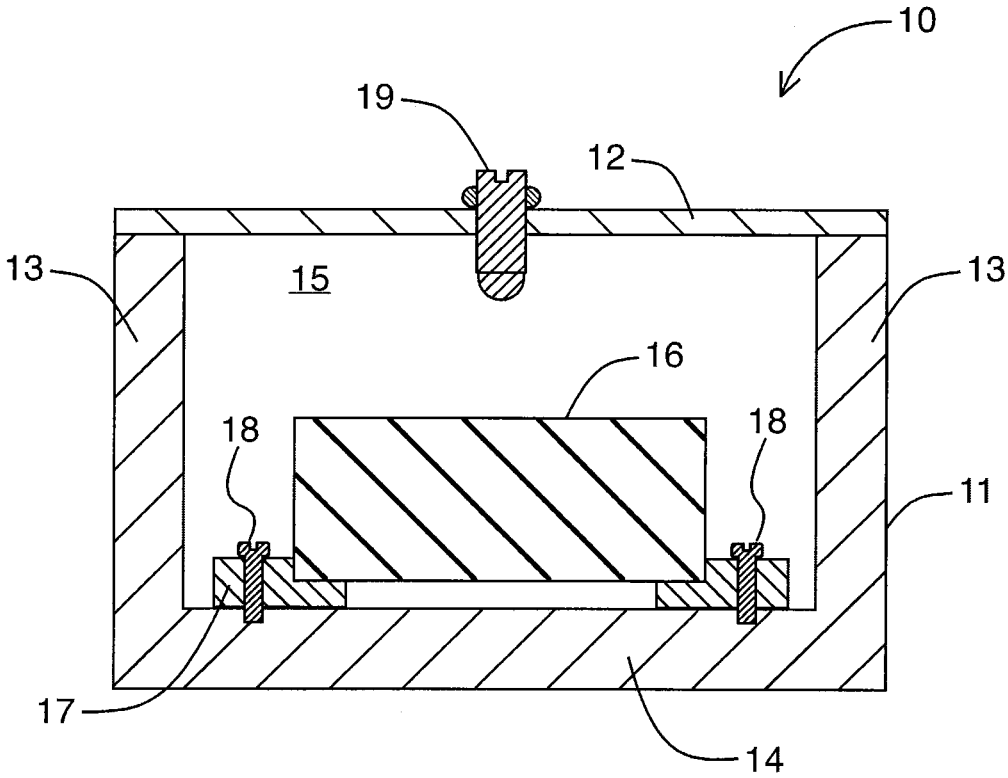
FIG. 1 PRIOR ART
FIG. 1 is a cross-sectional view of a prior art TM mode dielectric resonator assembly.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE INVENTION

It will be appreciated that numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way, but rather as merely describing the implementation of the various embodiments described herein.

Referring now to FIG. 1, a prior art TM mode dielectric resonator assembly 10 is illustrated. It includes a housing 11 having a lid/top end wall 12, a bottom end wall 14 and a cylindrical sidewall 13. The walls are metallic and together form a cavity 15. The resonator assembly 10 can be tuned through the use of a tuning screw 19, arranged in the lid 12. Resonator element 16 is positioned within the cavity 15 through the use of a ring 17 formed with an inner annular shoulder for receiving the dielectric resonator element 16 as shown. The dielectric resonator element 16 can be fastened within the annular shoulder of the ring 17 by an adhesive or by clamping action. The ring 17 is attached to the bottom end wall 14 of the housing 11 by screws 18. The spacing between the resonator element 16 and the bottom end wall 14 can decrease current induced in the bottom end wall 14 and thereby result in a higher Q for the assembly 10. The TM mode dielectric resonator assembly 10 has wider tuning range and simpler resonator arrangement with respect to the standard $TE_{01\delta}$ mode.

However, the extra space between the resonator element 16 and the bottom end wall 14 can also result in lack of heat conduction from the resonator element 16 to the housing 11. This can lead to undesirable run-away effects and overheating, under high power condition. Also, the TM mode dielectric resonator assembly 10 offers a lower Q-factor than the standard $TE_{01\delta}$ arrangement and no suitable material has been found to recover the lowered Q factor. Furthermore, the range of spurious-free frequency is reduced with respect to the standard $TE_{01\delta}$ arrangement. Consequently, the resonator assembly 10 can only be considered for low frequency application such as L-Band and S-Band since it is not suitable for higher frequency bands.

Figure 2:
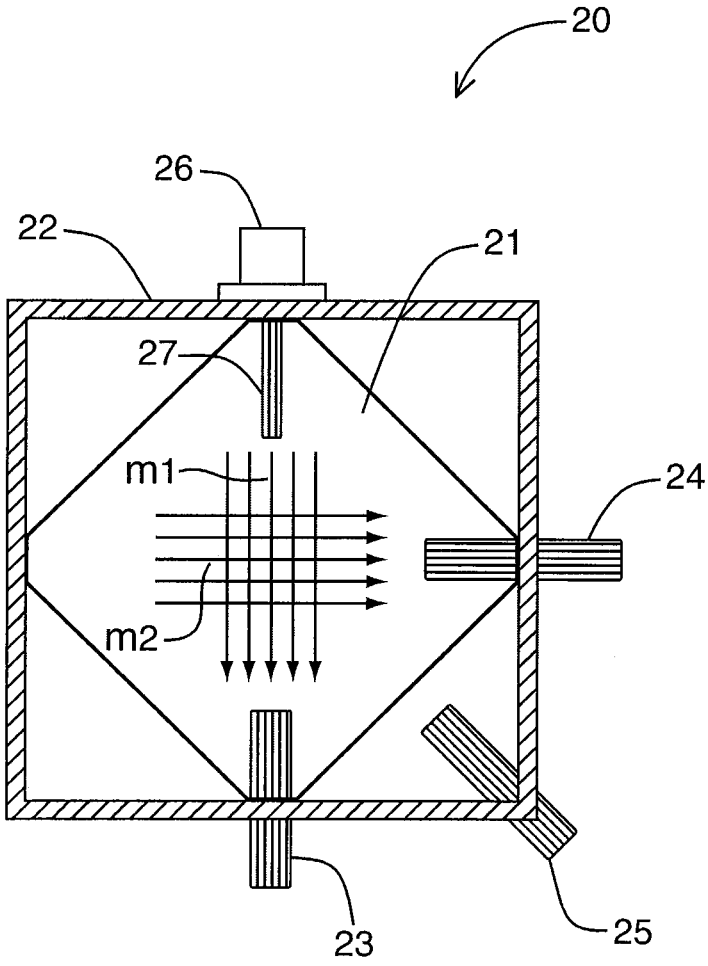
FIG. 2 PRIOR ART
FIG. 2 is a schematic diagram showing the orthogonal TE modes of a prior art microwave multimode resonator assembly.

Referring now to FIG. 2, a prior art TE multimode resonator assembly 20 is shown. The resonator assembly 20 includes a resonator element 21 and a housing 22. The resonator assembly 20 also includes a first tuning screw 23 for tuning a first mode m1, a second tuning screw 24 for tuning a second mode m2, and a coupling screw 25 for varying the coupling of energy between the two orthogonal excitation modes m1 and m2 of the resonator element 21. Coupling means 26 and 27 are included for inlet and outlet cavities for either coupling microwave energy into an inlet cavity or extracting it from an outlet cavity. Furthermore, the resonator element 21 is essentially planar, having a thickness and an outline in the form of a polygon with n sides and n vertices which are short-circuited together by the conducting housing as shown.

In FIG. 2, the resonator element 21 has an outline in the form of a parallelogram with four sides and four vertices. The vertices are truncated or rounded so as to fit closely to the shape of the housing. The resonator element is in mechanical and electrical contact with the housing that enables the resonator element to be positioned exactly and reproducibility inside the resonator cavity and without the need for a support element that is necessary in the standard TE mode resonator assemblies (see FIG. 3). The mechanical contacts also facilitate the transfer of heat from the resonator element to the housing. Furthermore, the two orthogonal modes m1 and m2 of the resonator assembly are excited in TE mode as opposed to the HE mode. They are orthogonal merely because of the square shape of the housing and the parallelepipedal shape of the resonator element.

However, this configuration still suffers from deficiency of heat transfer between the resonator element 21 and the housing 22 due to the spacing between them. Although having the dielectric resonator element 21 touching the metal housing 22 at the four vertices helps to dissipate the heat from the dielectric resonator element, doing so also degrades the Q-factor. The mounting of the dielectric resonator element 21 inside the cavity can also be complicated and requires very precise machining and mechanical processes to minimize bond line thickness. In addition, the TE dual mode operation of the resonator assembly 20 will reduce the power handling capability due to the higher power dissipation inside the dielectric resonator element with respect to a single mode cavity. Thus the achievable Q factor is likely to be lower than a standard TE mode resonator assembly with a cylindrical hollow INVAR® (i.e., nickel steel alloy) cavity, especially at high frequency such as the Ku Band for satellite communication system.

In other standard resonator assemblies, resonator elements can be positioned within housings and held in position by an insulating mount in the form of pellets or columns of insulating material having low dielectric losses, such as polystyrene or PTFE. Such mounts have numerous mechanical and operational drawbacks both during assembly and during operation of the known filter. An example of another standard resonator assembly using the above-mentioned mounts is the dual-mode resonator assembly.

Figure 3:
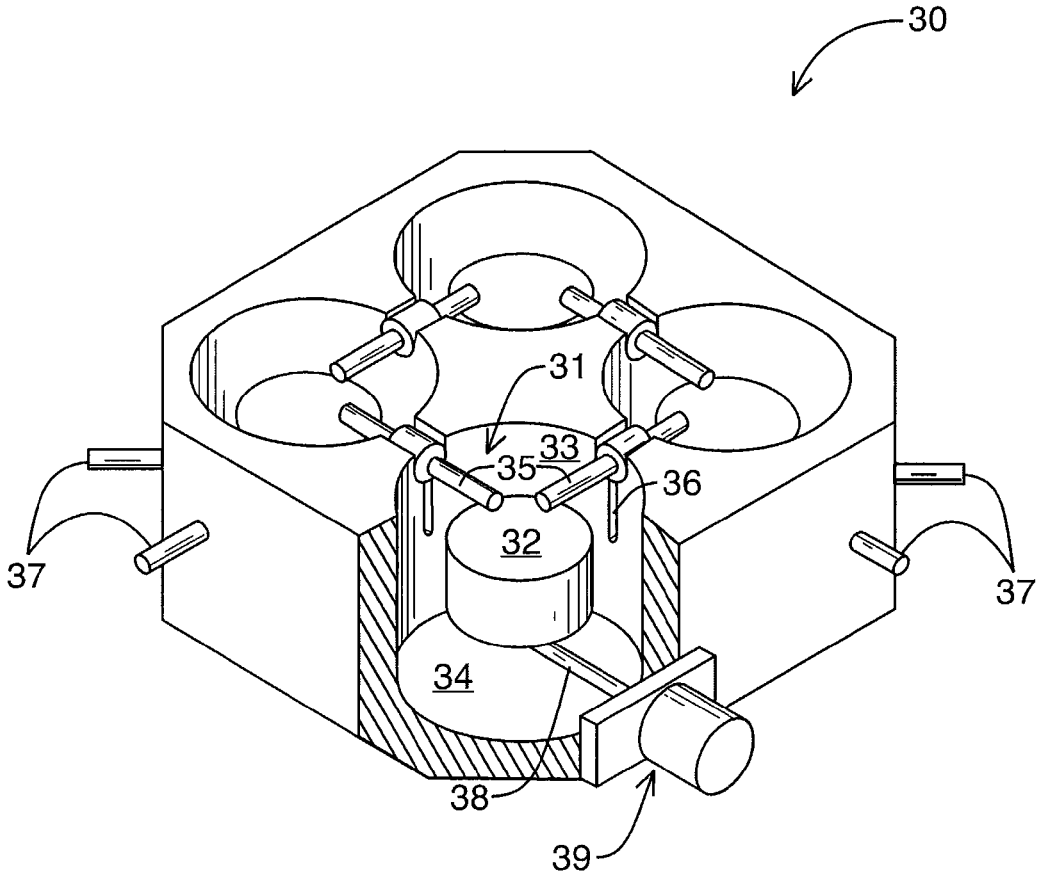
FIG. 3 PRIOR ART
FIG. 3 is a top perspective view showing a prior art dual mode HE filter assembly.

Referring now to FIG. 3, a prior art dual-mode resonator assembly 30 is shown. The dual-mode resonator assembly 30 comprises four dielectric resonators 32 positioned within four cavities 31 formed by a sidewall 33 and a bottom wall 34. Probes 35 and iris openings 36 are provided for coupling adjacent and non-adjacent modes of the neighboring resonators 32. Tuning screws 37 are provided to protrude through sidewalls 33 of cavities 31 for provoking derivative orthogonal modes and for determining the degree of coupling between orthogonal modes within a resonator. Port 39 is shown with an inner conductive proboscis 38 extending into the cavity 31.

The prior art dual-mode resonator assembly 30 permits filter mass and size reduction in comparison with a single mode technology. However power dissipation is greatly confined inside the puck and will almost double with respect to a single mode resonator, thus reducing the power handling of the dual-mode structure.

Furthermore, although not shown in FIG. 3, the resonator 32 is kept in place within cavity 31 by a material having a low dielectric constant, such as STYROFOAM® (i.e., extruded polystyrene foam), or by a metal or dielectric screw (or other means) disposed along the vertical cylindrical axis of the resonator 32 and cavity 31. The insertion loss of the filter is determined by the Q-factors of the individual dielectric resonator 32 loaded cavities 31, which in turn depends upon the loss of the dielectric resonator 32 material and the material used to position and support the resonator 32 within the cavity 31. This leads to a similar problem in terms of the bonding and heat flow management of the standard $TE_{01\delta}$ design (FIG. 4), except that the problem is further amplified in the case of a dual-mode resonator assembly 30. This is because the dissipation inside the resonator of a dual-mode structure is nearly double that of a single mode design. To realize a practicable high power filter using such a design approach requires careful navigation within a complex design space, which may be prohibitive at high frequencies like the Ku-Band.

Figure 4:
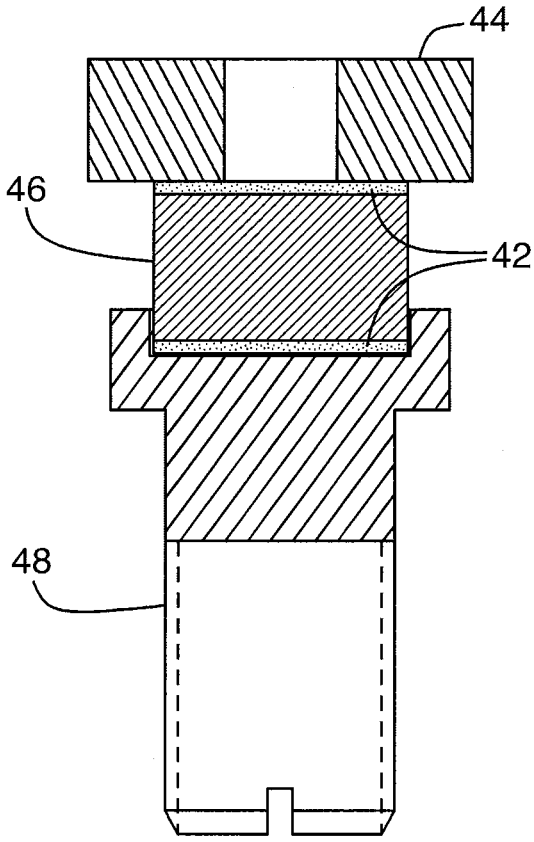
FIG. 4 PRIOR ART
FIG. 4 is cross-sectional view of a prior art resonator element and support mounting assembly.

FIG. 4 illustrates a standard mounting technique for the $TE_{01\delta}$ mode resonator assembly. A typical dielectric resonator assembly with high Q-factor using $TE_{01\delta}$ mode includes a cylindrical resonator element 44 made from a dielectric material that has a high dielectric constant (i.e. a dielectric constant greater than 20), and a high Q factor. The dielectric resonator element 44, usually called a "puck", is mounted on top of a support 46 made of lower dielectric constant material such as polystyrene, quartz, or other suitable material. In turn, the support is held in place by a pedestal 48 that connects to the base of the cavity wall structure (not shown).

This prior art mounting technique is usually employed in a highly constrained mechanical design space. The cantilevered structure formed by the resonator element 44, the support 46 and the pedestal 48, is susceptible to high loading under lateral vibration or pyrotechnic shock forces when space applications are considered. The choice of dielectric materials and geometry are dominated by RF considerations resulting in limited control over moments and strength properties of the structure. These RF design constraints offer few fastening options for the resonator element 44 and the support 46. Accordingly, these components are usually held in place via bonds 42, which can be problematic. The bonding material must exhibit sufficient adhesion over the full operational temperature range. The cohesive strength of the bonds 42 must also be adequate and this property is sensitive to the bond thickness. However, the bond thickness also affects both the transfer of heat out of the resonator element and the additional RF dissipation within the bond 42. Further, thermally induced shear stresses on the bonded surfaces (resulting from disparate coefficients of thermal expansion) must be acceptable and it is dependent on bond thickness as well.

Heat flow management is bounded by the parameters such as, but not limited to, heat dissipation, thermal conductivity of the materials, and various section surface sizes and shapes (which effects the thermodynamic properties of the components). However, varying these factors are likely to have a concomitant effect on the Q factor of the overall resonator assembly. Of particular interest is the bonding material used for the bonds, which can be treated as a series heat conduction path and a heat dissipation source.

An important issue to consider is the potential formation of adiabatic barriers, wherein modest heat dissipation within a very small volume can result in a significant, but localized, temperature rise. When such a hot spot is in series with heat flow, the base level for all upstream heat sources is raised accordingly. The Q factor will not suffer if the electromagnetic field is confined within the resonator element. To maximize the confinement of the electromagnetic field within the resonator element, it is generally needed to minimize the resonator element's contact area to the surrounding walls or the enclosure, which leads to poor heat dissipation. The problem with the trade-off of heat flow management and the Q factor has not been addressed appropriately or optimized according by the prior art resonator assemblies shown above.

In regard to heat flow management for dual-mode resonator assemblies such as the resonator assembly 30 shown in FIG. 3, it is noteworthy that dielectric dual-mode technologies allow for filter mass and size reduction in comparison with a single mode technology. However, power dissipation is greatly confined inside the puck and nearly doubles with respect to a single mode resonator assembly. Heat dissipation remains an even more challenging issue thus effectively reducing the power handling of the dual-mode structure.

Figure 5:
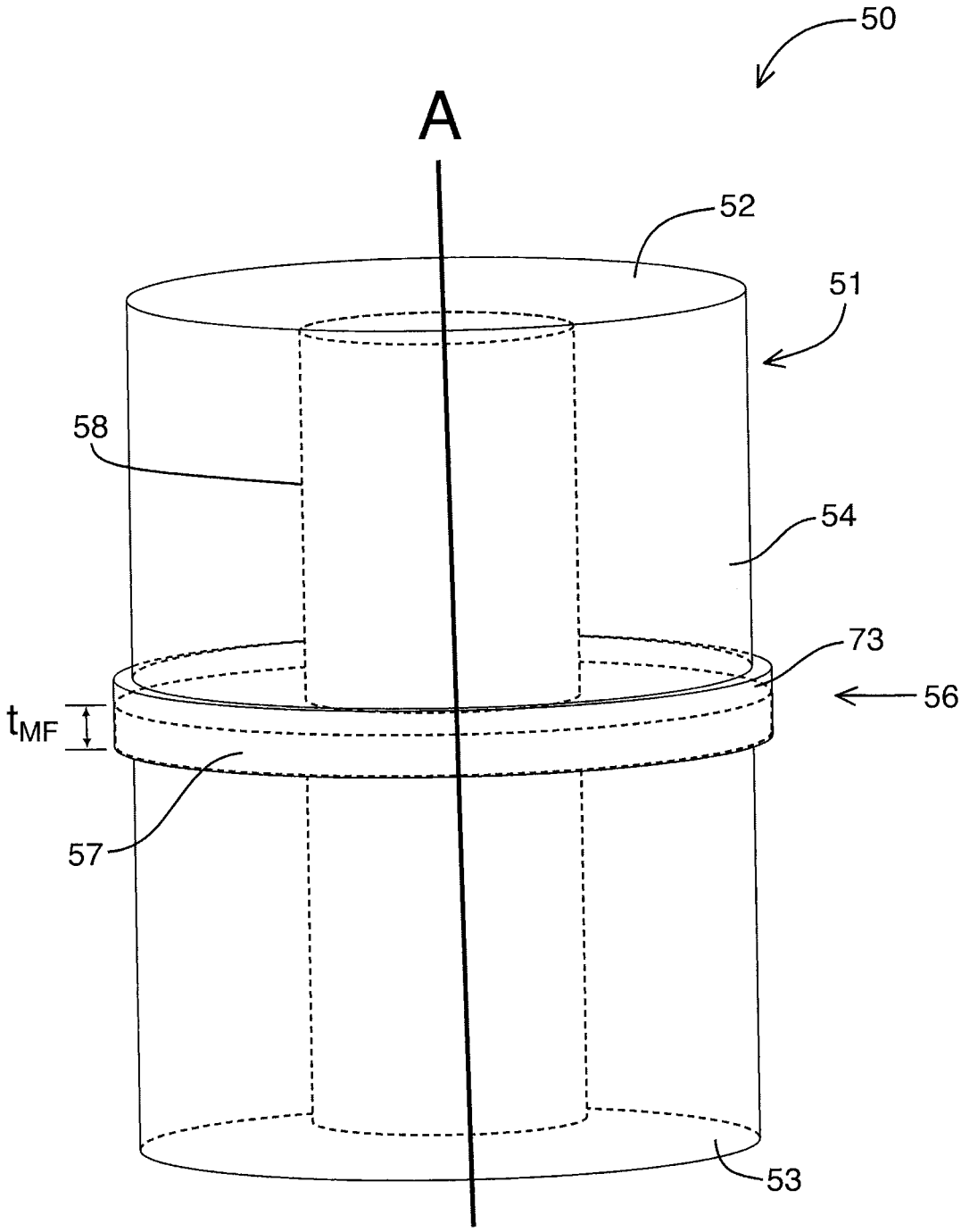
FIG. 5 is a side perspective view of an exemplary resonator cavity.

Referring now to FIG. 5, illustrated therein is an exemplary resonator cavity 50 that includes a cavity 51, a resonator element 58, and a mounting flange 57. Conventional tuning screws and coupling means may be utilized within the resonator cavity 50 as will be discussed.

The cavity 51 is defined by a top end wall 52, a bottom end wall 53 and a sidewall 54 that is preferably cylindrical as shown in FIG. 5. Also, cavity 51 has a longitudinal axis A along which the length of the cavity 51 is defined. It should be understood that while the present description will focus on a cylindrical cavity 51 with a circular cross-section, cavity 51 could instead be implemented having any shape and cross-section. Cavity 51 is made from a metallic material.

The resonator element 58 includes a generally cylindrical dielectric rod with a circular cross-section that is positioned within the cavity 51 along the longitudinal axis A of the cavity 51. The length of the resonator element 58 is also defined along the longitudinal axis A. It should be understood that the generally cylindrical dielectric rod of the resonator element 58 could also have an elliptical, square, or polygonal cross-section. In such cases, it should be also understood that the mounting flange 57 would be suitably shaped to surround the dielectric rod of the resonator element 58. The generally cylindrical dielectric rod of the resonator element 58 is made from a dielectric material with a low relative permittivity (i.e. a low dielectric constant of less than 20) and a low loss tangent.

The resonator element 58 also includes a mounting flange 57 that is preferably a flat annular (i.e. ring-shaped) extension with a thickness of $t_{MF}$ and an outer radius slightly larger than the inner radius of the cavity 51 as shown in FIGS. 5, 8, 10A and 10B. However, while the lateral cross-section of the mounting flange 57 is preferably rectangular (FIGS. 10A, 10B), it should be understood that the lateral cross-section could also be circular, square, triangular, etc. Also while the mounting flange 57 is preferably formed in a continuous ring so that it completely surrounds the resonator element 58, the mounting flange 57 could instead be formed to extend along only a portion of the circumference of resonator element 58. Also, while mounting flange 57 is preferably formed to be symmetrical around the longitudinal axis A, it may also be unsymmetrically formed. The mounting flange 57 is preferably made from a dielectric material with a low relative permittivity and a low loss tangent.

Mounting flange 57 is preferably integrally formed with the rest of resonator element 58. However, it should be understood that it is possible to manufacture the mounting flange 57 separately and to then couple mounting flange 57 to the rest of resonator element 58 using bonding or other conventional means. However, in such a case, degradation of Q will result making such an arrangement less desirable.

As shown in FIG. 5, the resonator element 58 is positioned within and coupled to the cavity 51 through the mounting flange 57 at a mounting location 56. Preferably the mounting flange 57 is secured within the cavity 51 using a spring element and counter bore 73 configuration as will be further described in further detail with respect to FIGS. 8, 10A and 10B. The resonator element 58 is mounted within the cavity 51 using various mechanical methods without significantly compromising performance or Q factor. For example, resilient epoxy or a resilient spring element can be used.

The preferred mounting location 56 for the exemplary resonator assembly 50 of FIG. 5 is where at least one resonant mode of the electromagnetic energy exhibits a local minima. Accordingly, the resonator element 58 is only in physical contact with the cavity 51 through the mounting flange 57 where at least one resonant mode of the electromagnetic energy exhibits a local minima. A local minima can occur at a variety of points along the length of the resonator element 58 depending on the repetition rate of the electromagnetic field pattern along the length of the resonator, as will be discussed in more detail in relation to FIGS. 7A and 7B.

FIG. 5 illustrates how the mounting flange 57 is positioned within resonator cavity 50 in the presence of an electromagnetic field pattern that substantially repeats itself twice along the length of the resonator. As will be further discussed, positioning of the mounting flange 57 within resonator cavity 50 will vary according to the electromagnetic field pattern present within the resonator cavity 50 (e.g. see FIG. 7B).

Figure 7A:
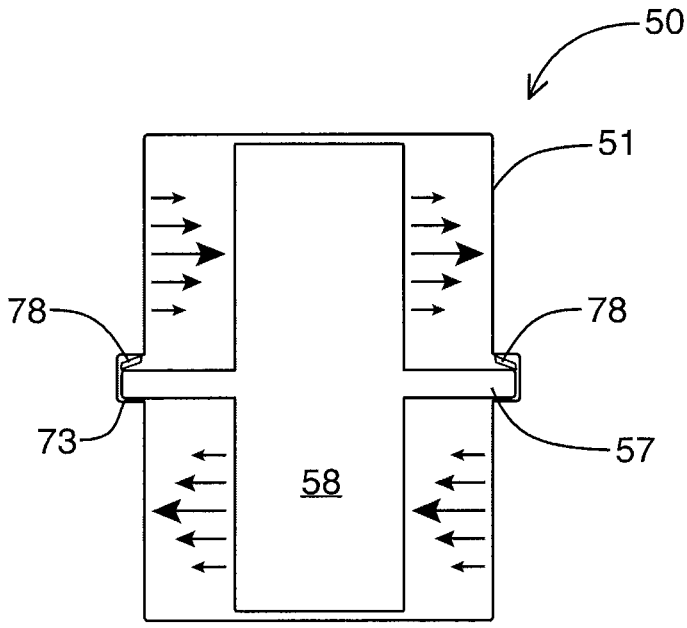
FIG. 7A is a graphical representation of one exemplary electromagnetic field pattern for the excited resonator cavity of FIG. 5.

In the exemplary configuration shown in FIG. 5, it is assumed that the dimensions of the cavity 51 and the resonator element 58 have been selected so that the electromagnetic energy associated with the resonator cavity 58 is defined by an electromagnetic field pattern that substantially repeats itself twice along the length of the resonator (FIG. 7A). In this situation, the preferred mounting location 56 for the exemplary resonator assembly 50 of FIG. 5 is at the approximate midpoint of the length of the resonator element 58 where at least one resonant mode of the electromagnetic energy exhibits a local minima. Accordingly, the resonator element 58 is only in physical contact with the cavity 51 through the mounting flange 57 at the circumferential region at the approximate midpoint of the length of the resonator element 58 as shown.

The top and bottom ends of resonator element 58 are not in physical contact with the top or bottom walls 52 and 53 of the cavity 51. Rather, a space gap is formed between the top end of the resonator element 58 and the top end wall 52 of the cavity 51 and another space gap is formed between the bottom end of the resonator element 58 and the bottom end wall 53 of the cavity 51. These space gaps are designed to provide the resonator cavity 50 with thermal stability, that is the ability to maintain a fixed resonator frequency while the temperature of the resonator cavity 50 changes. This is because the space gaps allow space for the top and/or bottom end walls of the cavity 51 to be deformed into when acted on by an external force in the presence of temperature changes (e.g. as discussed in U.S. Pat. No. 6,535,087 to Fitzpatrick et al.) allowing for temperature compensation.

As will be discussed in further detail in relation to FIGS. 7A and 7B, certain resonant modes of the electrical field generated by the resonator assembly 50 exhibit one or more local minimas along the length of the resonator element 58. The resonator element 58 is only in physical contact with the cavity 51 through the mounting flange 57 at the appropriate mounting location 56. The mounting location 58 is selected to be along the length of the resonator element 58 where certain resonant modes of the generated electromagnetic energy exhibit a local minima.

Figure 6A:
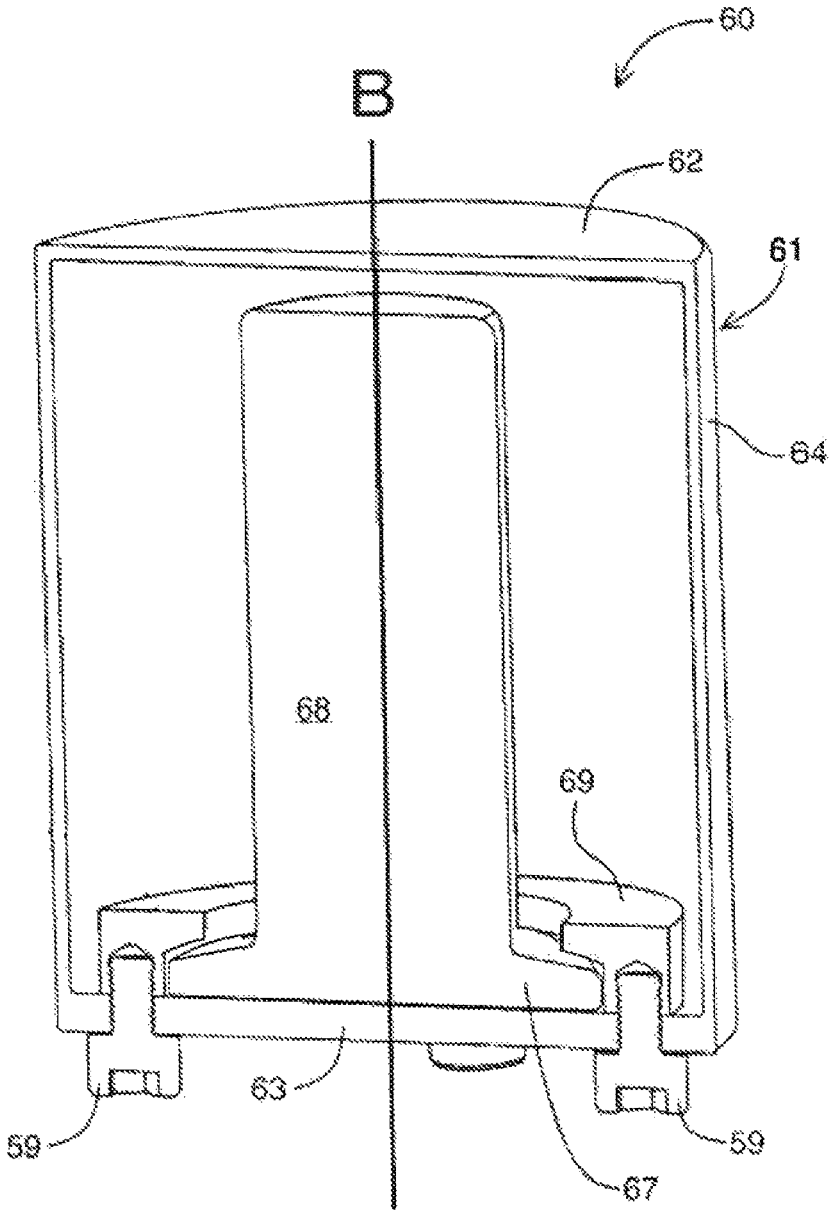
FIG. 6A is a cross-sectional view of another exemplary resonator cavity wherein the mounting flange is secured to the bottom of the cavity using a clamping collar without a spring.
Figure 6B:
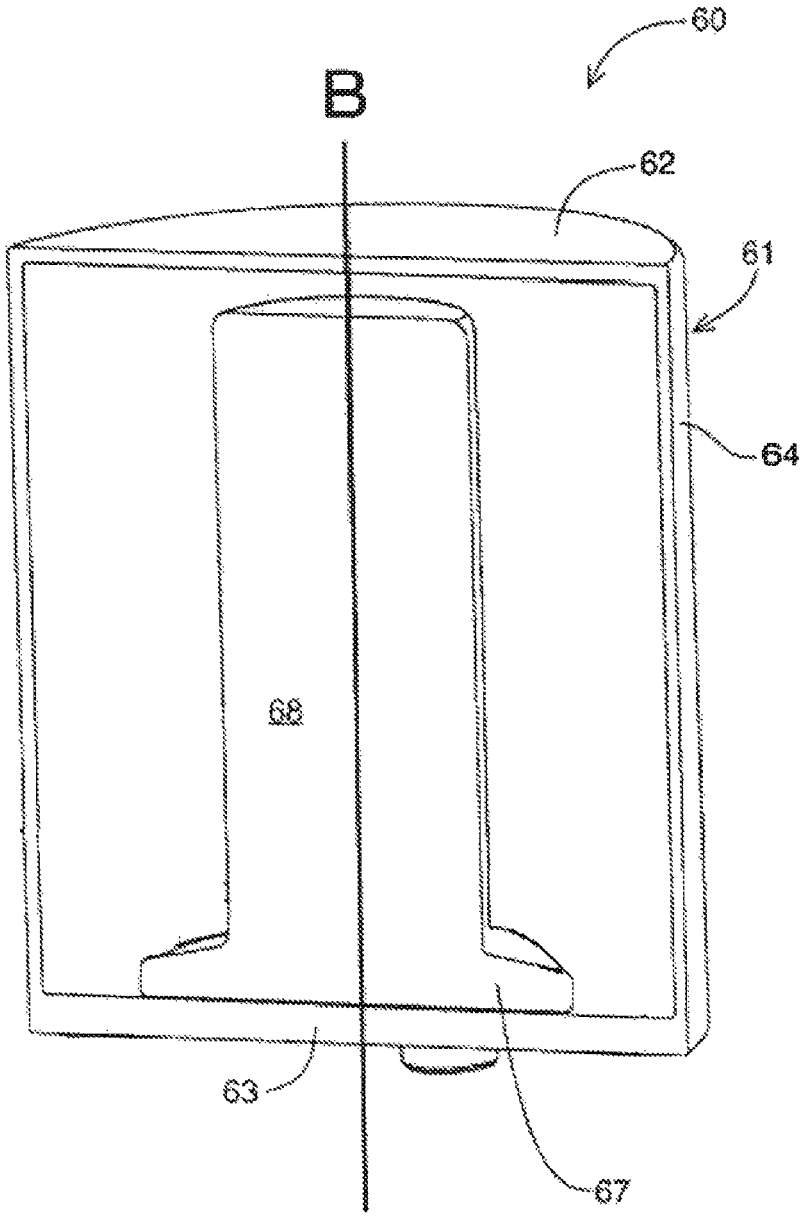
FIG 6B is a cross-sectional view of another exemplary resonator cavity where the resonator element and mounting flange is coupled to the cavity via bonding.
Figure 6C:
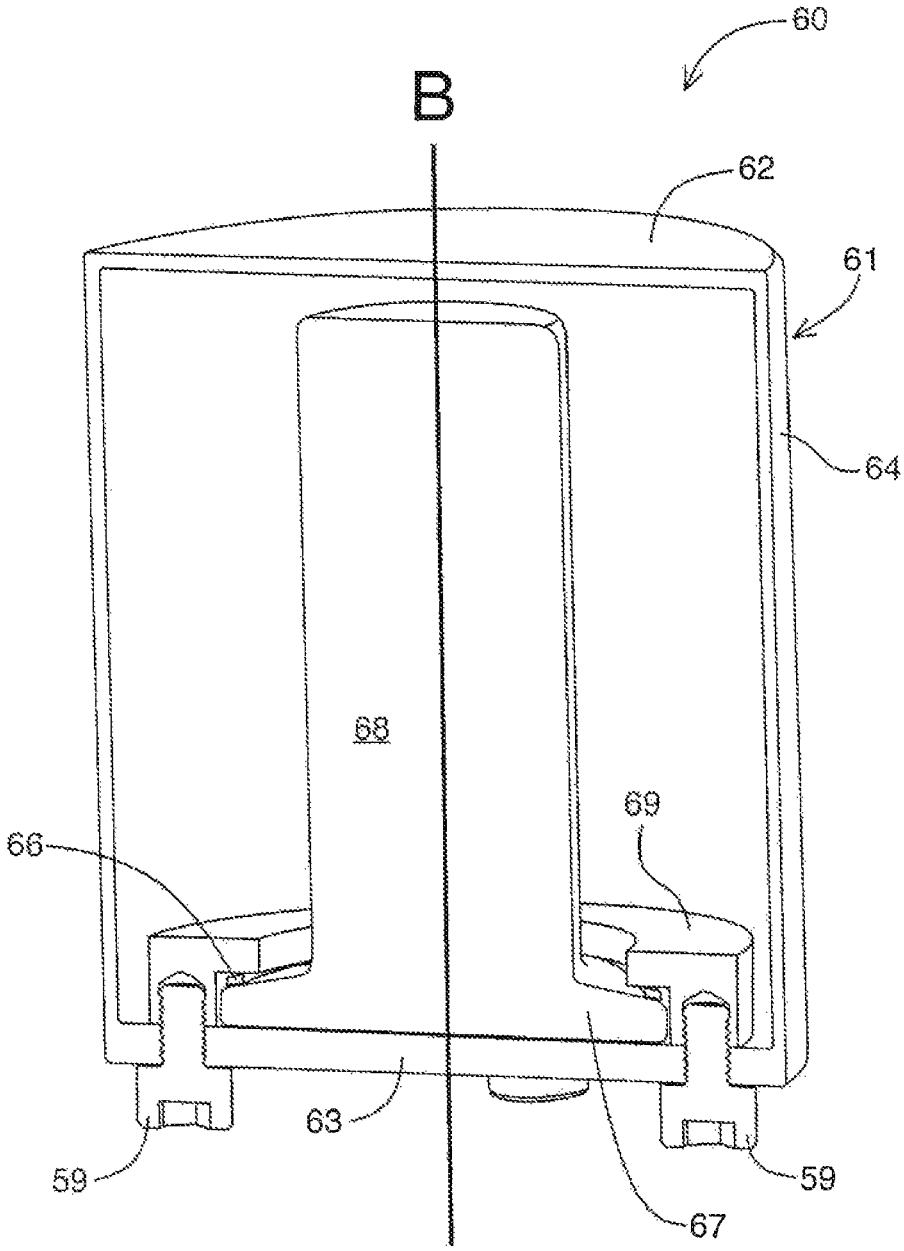
FIG 6C is a cross-sectional view of another exemplary resonator cavity where the mounting flange is secured to the bottom of the cavity using a clamping collar and a spring mechanism.

Referring now to FIG. 6A, 6B and 6C, another exemplary resonator cavity 60 is illustrated including a cavity 61, a resonator element 68 and a mounting flange 67. Conventional tuning screws and coupling means may be utilized within the resonator cavity 60.

The cavity 61 is defined by a top end wall 62, a bottom end wall 63 and a sidewall 64 and is typically cylindrical as shown in FIGS. 6A, 6B and 6C. Also, cavity 61 has a longitudinal axis B along which it's length is defined. As discussed above, it should be understood that while the present description will focus on a cylindrical cavity 61 with a circular cross-section, cavity 61 could instead be implemented having any shape and cross-section. Cavity 61 is made from a metallic material.

The resonator element 68 is positioned within the cavity 61 along longitudinal axis B and includes a generally cylindrical dielectric rod. The length of the resonator element 68 is also defined along the longitudinal axis B. It should be understood that the generally cylindrical dielectric rod of the resonator element 68 could also have a circular, elliptical or polygonal cross-section. The resonator element 68 is made from a dielectric material with a low relative permittivity (i.e. low dielectric constant of less than 20) and a low loss tangent.

The resonator element 68 also includes a mounting flange 67 which is preferably a slightly sloped annular (i.e. ring-shaped) extension with a radius that is generally less than that of the cavity 61 as shown. However, the mounting flange 67 could also have other various shapes. As discussed above, while the lateral cross-section of the mounting flange 67 is preferably sloped as shown it should be understood that the lateral cross-section could also be circular, square, triangular, etc. Also while the mounting flange 67 is preferably formed in a continuous ring so that it completely surrounds the resonator element 68, the mounting flange 67 could instead be formed to extend along only a portion of the circumference of resonator element 68. Also, while mounting flange 67 is preferably formed to be symmetrical around the longitudinal axis B, it may also be unsymmetrically formed.

For structural strength, mounting flange 67 is preferably thicker at the region where it meets the generally cylindrical rod of resonator element 68 to ensure that operational vibrations do not lead to cracking or other damage to the resonator element 68.

Also as discussed, above in relation to the exemplary resonator cavity 50 of FIG. 5, the mounting flange 67 is preferably integrally formed with the generally cylindrical rod of the resonator element 68. However, it should be understood that it is possible to manufacture the mounting flange 67 separately and to then couple mounting flange 67 to the rest of resonator element 68 using bonding or other conventional means. However, in such a case, degradation of Q will result making such an arrangement less desirable.

As shown in FIGS. 6A, 6B and 6C, the complete bottom surface of the resonator element 68 which consists of the bottom surface of the generally cylindrical rod and the bottom surface of the mounting flange 67, is coupled to the bottom end wall 63 of the cavity 61. Various known methods may be used for mounting the bottom surface of the resonator element 68 to the bottom end wall of the cavity 61 such as epoxy, a clamping collar, a metal spring mechanism or a combination thereof. Specifically, FIG. 6A shows an exemplary resonator cavity 61 wherein the mounting flange 67 is secured to the bottom of the cavity using a bolt 59 a clamping collar 69 without a spring. FIG. 6B shows an exemplary resonator cavity 61 where the resonator element 68 and mounting flange 67 is coupled to the cavity via bonding (e.g. epoxy). FIG. 6C shows an exemplary resonator cavity 61 where the mounting flange 67 is secured to the bottom of the cavity using a clamping collar 69 and a spring 66.

For illustrative purposes, the combination of a metal clamping collar 69 and spring 66 mechanism is shown in FIG. 6C. Specifically, a clamping collar 69 is provided which can be positioned over an outer portion of the mounting flange 67 of the resonator element 68 and secured to the bottom of the cavity 61 using bolts 59 as shown. When the clamping collar 69 is bolted into place on the bottom of the cavity 61, the spring 66 of the clamping collar 69 is forced down onto the mounting flange 67 securing the resonator element 68 into place through deflection pressure exerted by the spring 66 on the edge of the mounting flange 67. The clamping collar may be made of metal or dielectric material.

Alternatively, as shown in FIG. 6A, the clamping collar 69 can be used without a spring 66, as shown in FIG. 6C, to secure mounting flange 67 in place. In order to do so the bottom surface of the portion of the clamping collar 69 that overhangs the mounting flange 67 is shaped to contact the mounting flange 67 along a contact region to secure mounting flange 67 and resonator element 68 in place. In that configuration, clamping collar 69 is also provided with a spring constant so that it acts as a spring itself to provide deflection pressure on the edge of the mounting flange 67.

The top end of resonator element 68 is not in physical contact with the cavity 61 and instead a space gap is formed between the top end of the resonator element 68 and the top end wall of the cavity 61 providing similar temperature compensation facility as discussed in relation to the resonator cavity 50 of FIG. 5 above.

The resonator cavity 60 of FIGS. 6A, 6B and 6C exhibits certain operational advantages, which are different from the resonator cavity 50 of FIG. 5. Specifically, since the bottom surface of the resonator element 68 which consists of the bottom surface of the generally cylindrical rod and the bottom surface of the mounting flange 67, is in complete surface contact with the bottom end wall of cavity 61, resonator cavity 60 of FIGS. 6A, 6B and 6C is provided with minimal thermal resistance and an extremely effective heat sink from the low dielectric constant resonator element 68 to ground. This thermal grounding makes the resonator cavity 60 particularly suitable for higher power applications since the heat created can be effectively dissipated by the resonator cavity 60 structure.

Also, since the electromagnetic field pattern repeats itself at least twice along the length of the resonator element 68 means that high magnetic field regions are located at the ends of the resonator element 68. The resonator element 68 which has a low dielectric constant is only is in contact with the cavity 61 in one of these high magnetic field regions. This minimizes the impact on quality factor Q. In contrast, it is not possible to use typical prior art resonator cavities that use a resonator element 68 with lower dielectric constant for high power applications since the quality factor Q will be much more drastically reduced.

Furthermore, the resonator element 68 may only be in physical contact with the cavity 61 through the mounting flange 67 at the bottom end wall 63 where at least one resonant mode of the electromagnetic energy exhibits a local minimum. As it will be appreciated from FIGS. 6A, 6B and 6C, the location of the contact between the mounting flange 67 and the bottom end wall 63 resides within a plane that is orthogonal to the longitudinal axis B of the cavity 61. Accordingly, the local minimum is also resident with the plane orthogonal to the longitudinal axis B of the cavity 61.

However, the resonator cavity 50 shown in FIG. 5 typically has a higher Q factor than the resonator cavity 60 of FIGS. 6A, 6B and 6C. This is because the dielectric resonator element 58 in FIG. 5 is in physical contact with the cavity 51 only where the mounting flange 57 and the sidewall 54 are in contact. This location is where the electromagnetic field is at a minimum as will be discussed in more detail in relation to FIGS. 7A and 7B. Therefore, while a certain amount of heat dissipation from the resonator element 58 to the cavity 51 through the mounting flange 57 is provided, less electromagnetic energy is transferred to the cavity sidewall 51 than is the case in the resonator cavity 60 of FIGS. 6A, 6B and 6C where the resonator element 58 contacts the cavity 61 at the bottom of the sidewall 64.

Figure 7B:
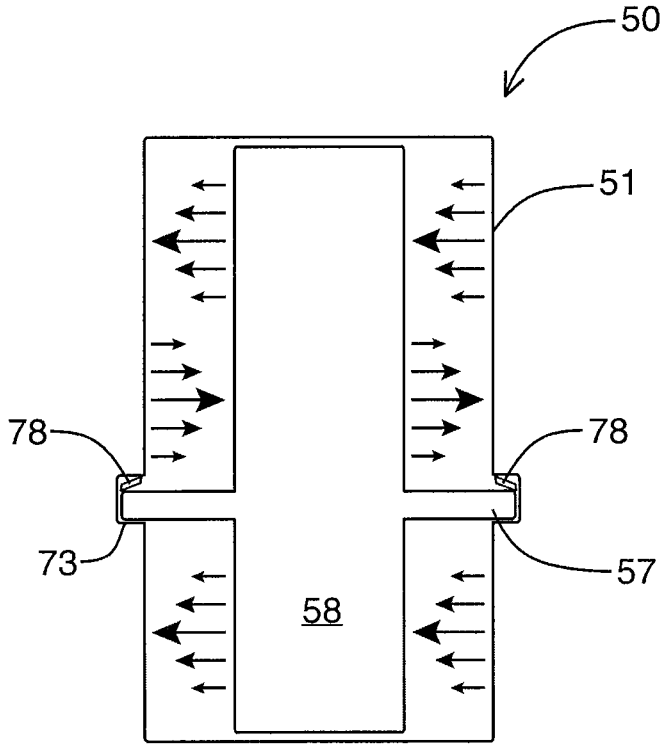
FIG. 7B is a graphical representation of another exemplary electromagnetic field pattern for the excited resonator cavity of FIG. 5.

Referring now to FIGS. 7A and 7B, the electromagnetic field pattern associated with two excited exemplary resonator cavities 50 is shown.

In FIG. 7A, the dimensions of the cavity 51 and the resonator element 58 have been selected so that the electromagnetic energy associated with the resonator cavity 58 is defined by an electromagnetic field pattern that substantially repeats itself twice along the length of the resonator element 58. In this situation, the preferred mounting location for the exemplary resonator assembly 50 of FIG. 5 is at the approximate midpoint of the length of the resonator element 58 where at least one resonant mode of the electromagnetic energy exhibits a local minima. As shown, the mounting flange 57 is secured in place within the cavity 51 at this mounting location using a spring element 78 positioned within the counterbore 73 of the cavity 51 as will be further described in relation to FIGS. 8, 10A and 10B.

As shown, the electromagnetic field pattern around the top half of the resonator element 58 is repeated around the bottom half of resonator element 58. Also, the electromagnetic field radiating outward from the approximate midpoint of the longitudinal length of the resonator element 58 exhibits a minima in between the repeated electromagnetic patterns as shown. The specific dimensions of the cavity 51 and the resonator element 58 are selected to support a desired repetition of the electrical field pattern and to enhance the quality factor Q without degradation of the spurious free frequency range (i.e. without the excitation of other resonant modes). Specifically, the length of the resonator 58 and ratio of the cross-section size and length of the resonator 58 are selected for this purpose. The desired length of the resonator 58 is a result of such optimization using commercially available electromagnetic modeling software.

In FIG. 7B, the dimensions of the cavity 51 and the resonator element 58 have been selected so that the electromagnetic energy associated with the resonator cavity 58 is defined by an electromagnetic field pattern that substantially repeats itself three times along the length of the resonator element 58. Here, the preferred mounting location for the exemplary resonator assembly 50 of FIG. 5 is at approximately one third or two thirds along the length of the resonator element 58 where at least one resonant mode of the electromagnetic energy exhibits a local minima. Again, the mounting flange 57 is secured in place within the cavity 51 at this mounting location using a spring element 78 positioned within the counterbore 73 of the cavity 51 as will be further described in relation to FIGS. 8, 10A and 10B.

As shown, the electromagnetic field pattern around the top third of the resonator element 58 is repeated in the middle and at the bottom third of resonator element 58. Also, the electromagnetic field radiating outward at approximately one third or two thirds along the length of the resonator element 58 exhibits a minima as shown. As discussed above, the specific dimensions of the cavity 51 and the resonator element 58 are selected to support a desired repetition of the electrical field pattern and to enhance the quality factor Q without degradation of the spurious free frequency range (i.e. without the excitation of other resonant modes).

While FIGS. 7A and 7B illustrate the situation where the electromagnetic energy associated with the resonator cavity 58 is defined by an electromagnetic field pattern that substantially repeats itself two or three times along the length of the resonator element 58, it should be understood that the electromagnetic energy associated with the resonator cavity 58 may alternatively be defined by an electromagnetic field pattern that substantially repeats itself any number of times along the length of the resonator element 58. A preferred mounting location will then correspond to one of the positions along the resonator element 58 where at least one resonant mode of the electromagnetic energy exhibits a local minima.

The circumferential contact region where the mounting flange 57 and the sidewall 54 of the cavity 51 contact, exhibits a slightly stronger electromagnetic field then other areas of the sidewall. This can lower the design Q factor for the resonator cavity 50. However, if the contact region were to be elsewhere, such as through the bottom of the resonator element 68 and the end wall of the cavity 61 as shown in FIGS. 6A, 6B and 6C, then more electromagnetic energy would leak into the cavity walls, resulting in an even lower Q factor. This is because the electromagnetic field radiating near the bottom of the resonator element 58 is not at a minima. As discussed below, the dimensions of the cavity 51 and the resonator element 58 are selected so that the electromagnetic energy associated with the resonator cavity 51 is defined by an electromagnetic field pattern that substantially repeats itself a certain number along the length of the resonator.

Generally speaking, the exemplary resonator cavities 50 are designed so that a large amount of the electromagnetic energy is confined within the resonator element 58, with some electromagnetic energy being transferred out of the resonator element 58 into the cavity 51. However, little electromagnetic energy reaches sidewall 54 of the cavity 51, which is desirable.

Figure 8:
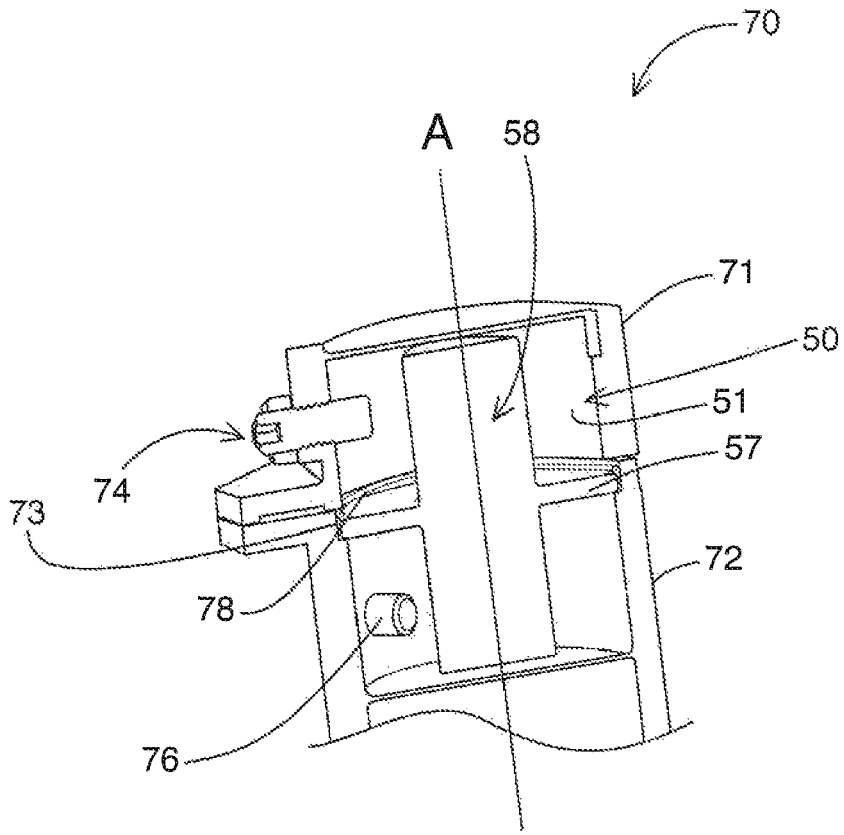
FIG. 8 is a cross-sectional side view of an exemplary resonator assembly comprising the resonator cavity of FIG. 5.

FIG. 8 illustrates a cross-sectional view of an exemplary resonator assembly 70 that includes a spring element 78, a lid 71, an enclosure 72 and the resonator cavity 50 of FIG. 5.

The cavity 51 of the resonator cavity 50 is a cylindrical space defined by the inner surfaces of the lid 71 and the enclosure 72. The lid 71 provides the upper half of the resonator cavity 51, namely a top end wall and the top half of the cylindrical sidewall. The enclosure 72 holds the resonator element 58 and provides the bottom half of the cavity 51, namely a bottom end wall and the bottom half of the cylindrical sidewall.

Figure 10A:
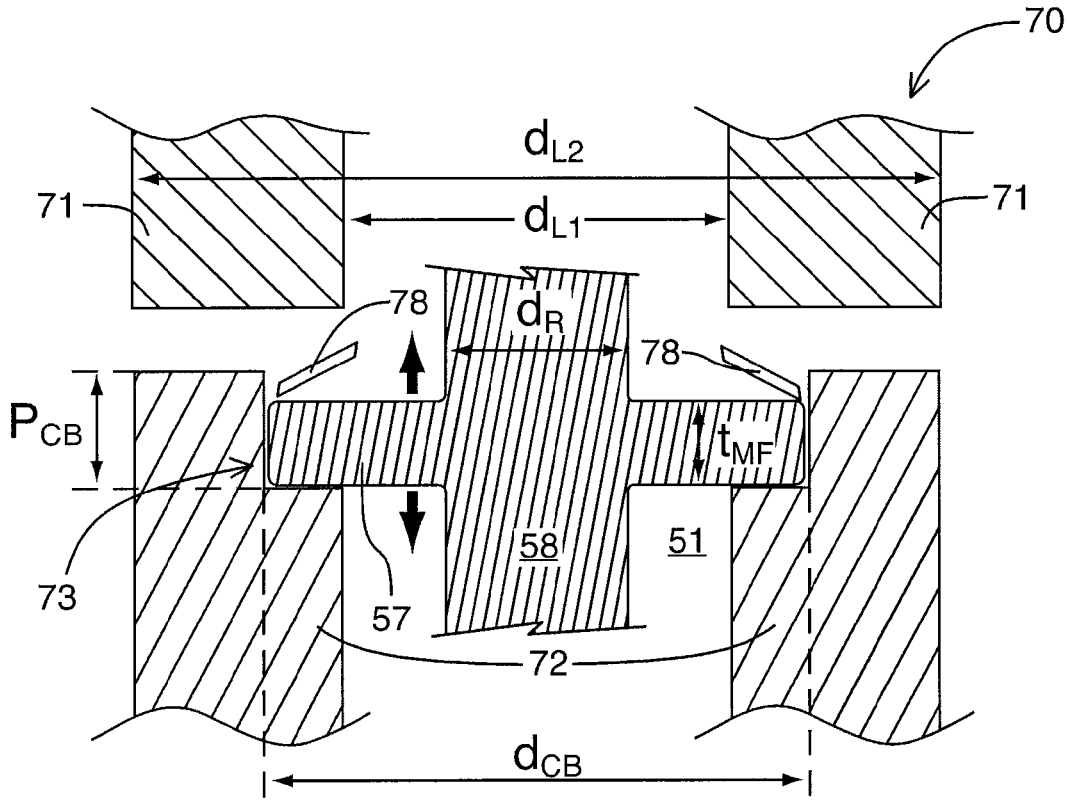
FIG. 10A is an enlarged cross-sectional view of the resonator assembly of FIG. 8 showing the position of the wave washer of FIG. 9A prior to engagement of the lid with the enclosure of FIG. 8.
Figure 10B:
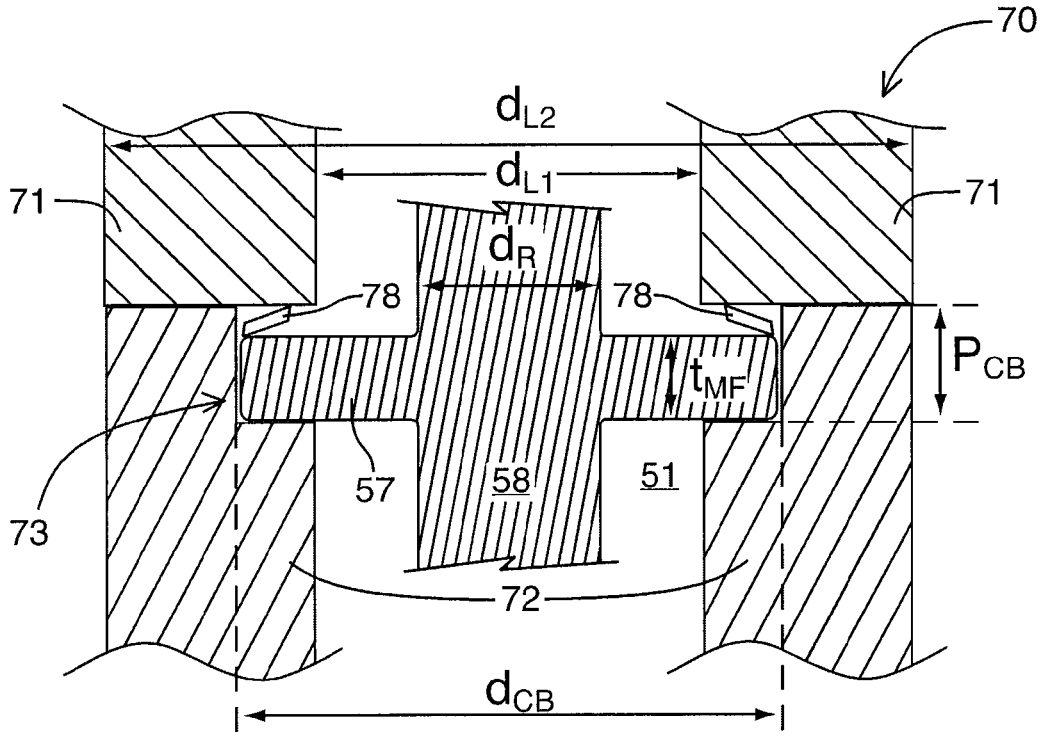
FIG. 10B is an enlarged cross-sectional view of the resonator assembly of FIG. 8 showing the position of the wave washer of FIG. 9A after engagement of the lid with the enclosure of FIG. 8.

The enclosure 72 further includes a counter bore 73 for receiving and supporting the mounting flange 57 (see FIGS. 10A and 10B). The counter bore 73 is formed as a small rectangular radial protrusion in the side of the enclosure 72. The counter bore 73 is sized to receive the outer edge of the mounting flange 57 as well as a spring element 78 (see FIGS. 10A and 10B).

The exemplary resonator assembly 70 shown has been designed for application to an electromagnetic field pattern that substantially repeats itself twice along the length of the resonator element 58. As discussed, the preferred mounting location for the exemplary resonator assembly 50 of FIG. 8 will be at the approximate midpoint of the length of the resonator element 58 where at least one resonant mode of the electromagnetic energy exhibits a local minima. However, it should be understood that the clamping mechanism of the assembly of FIG. 8 could equally be applied in the context of an electromagnetic field pattern that substantially repeats itself three or more times along the length of the resonator element 58. This could be done by rearranging the relative dimensions of the lid 71 and the enclosure 72, and the location of the counter bore 73 so that the mounting location for the mount flange corresponds to a position along the resonator element 58 where at least one resonant mode of the electromagnetic energy exhibits a local minima.

As shown in FIG. 8, in this case, the lid 71 and the enclosure 72 meet generally at a plane orthogonal to the longitudinal axis A of the cavity 51 and at the approximate midpoint of the length of the resonator element 58. As will be discussed, this arrangement effectively fixes the resonator element 58 within the resonator cavity 50 through a clamping force that is exerted on the mounting flange 57 by the lid 71 and enclosure 72 through a spring element 78 (e.g. a wave washer), as will be discussed in further detail in relation to FIGS. 10A and 10B.

The resonator assembly 70 can also include a tuning screw 74 and a coupling screw 76, as shown. The coupling screw 76 may be used to couple orthogonal modes between the cavities in the case of dual mode operation. Specifically, cross-coupling can be used between non-adjacent modes or cavities.

The electrical field patterns discussed are desirable because a repeated electromagnetic field pattern facilitates construction of complex elliptic functions which allow for strategic positioning of coupling elements (e.g. tuning screws and irises) to reduce unwanted coupling resulting in better filter performance. Specifically, a coupling screw 76 is shown located on the bottom part of the cavity 71 (FIG. 8) but it can also be located at the top part of the cavity 71 in the same plane as the tuning screw 74. The ability to position coupling elements at the top and bottom of the cavity 71 without compromising performance provides more design flexibility.

Figure 9A:
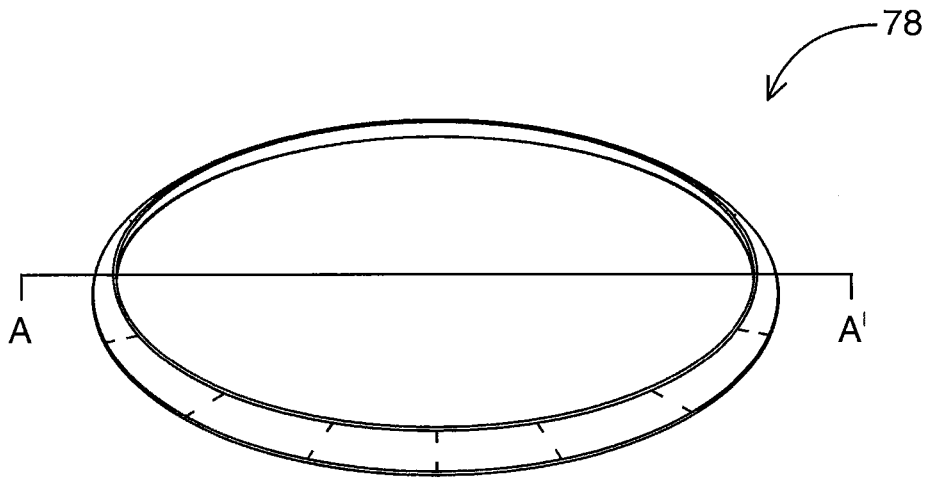
FIG. 9A is a top perspective view of the spring element of FIG. 8.
Figure 9B:
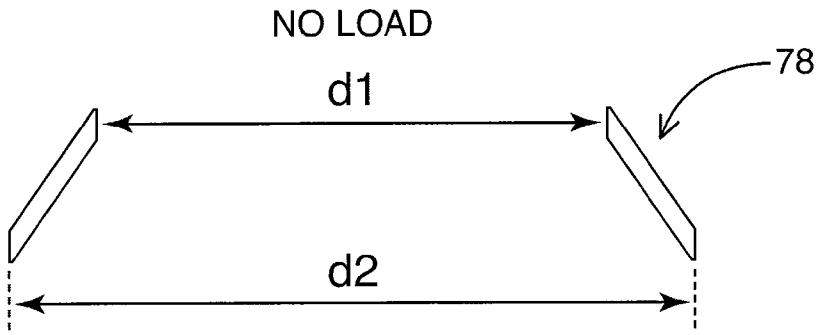
FIG. 9B illustrates a cross-sectional views of the wave washer of FIG. 9A along the dashed line AA' without an applied load.
Figure 9C:
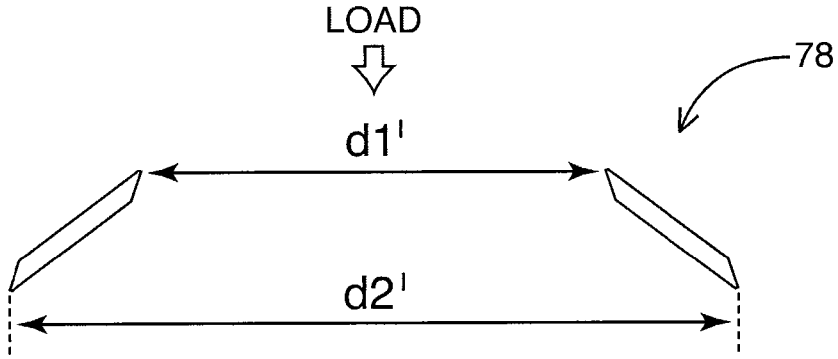
FIG. 9C illustrates a cross-sectional views of the wave washer of FIG. 9A along the dashed line AA' with an applied load.

FIGS. 9A, 9B and 9C together illustrate an exemplary spring element 78, namely a wave washer 78 in more detail. Specifically, FIGS. 9B and 9C show a cross sectional view of the wave washer 78 shown in FIG. 9A taken along the line A-A'. The wave washer 78 is made from a metal material characterized by good spring properties. However, it should be understood that the spring element 78 could be implemented using any other type of mechanical device having appropriate spring properties. Other types of mechanical devices may be made of metal, dielectric or other suitable materials.

A wave washer 78 is a type of non-flat washer, having a slight conical shape which gives the wave washer 78 a spring-like characteristic. When a load is applied as shown in FIG. 9C, the wave washer 78 deflects sideways and increases its unloaded outer diameter from d2 (FIG. 9B—no load condition) to the loaded outer diameter d2' (FIG. 9C—with load conditions) according to a specific spring constant. It should be noted that the unloaded inner diameter d1 (FIG. 9B) and the loaded diameter d1' (FIG. 9C) will respond similarly to the load.

Referring now to FIGS. 10A and 10B, illustrated therein are enlarged views of the interface between the enclosure 72 and the lid 71 of the resonator assembly 70. FIG. 10A illustrates the interface before the lid 71 is forced down on the enclosure 72 and FIG. 10B illustrates the interface after the lid 71 has been forced down on the enclosure 72.

In assembly, the resonator element 58 is first placed within the enclosure 72 such that the mounting flange 57 is positioned within the counter bore 73 as shown. Then, the wave washers 78 are placed on top of the top surface of the mounting flange 57. At this point, as shown in FIG. 10A, the wave washers 78 are in a relaxed (i.e. unloaded) state and protruding slightly above the enclosure 72. As shown in FIG. 10B, the lid 71 is then fastened onto the enclosure 72, depressing the wave washers 78 into the enclosure 72 and providing a clamping force onto the mounting flange 57 of the resonator element 58.

The clamping force provided this way prevents any potential small scale (e.g. micro) movements resulting from a loosely fixated resonator element 58, which may lower the performance or damage the device in critical applications. The lid 71 may be locked or clamped or snapped in place on the enclosure 72 by any known method after it is applied onto the enclosure 72.

As shown in FIGS. 10A and 10B, the cross section of the lid 71 has a thickness defined by an outer diameter $d_{L2}$ and an inner diameter $d_{L1}$. The generally cylindrical rod element of resonator element 58 has a diameter $d_R$ as shown and the mounting flange 57 has a thickness of $t_{MF}$. Also, the counter bore 73 has an outer diameter of $d_{CB}$. The wave washer 78, in addition to be characterized by a spring constant, must have a loaded inner diameter d1' (FIG. 9C) generally greater than the diameter of the resonator element $d_R$, and a loaded outer diameter d2' (FIG. 9C) generally greater than the inner diameter $d_{L1}$ of the lid and less than the diameter $d_{CB}$ of the counter bore.

The wave washer 78 is placed between the lid 71 and the mounting flange 57 of the resonator element 58 so that a clamping force is provided to the resonator element 58 to prevent small scale (i.e. micro) movements of the resonator element 58. However, it should be understood that the wave washer 78 may also be placed between the mounting flange 57 of the resonator element 58 and the enclosure 72, or both, for similar results.

Alternatively, the wave washer 78 may be eliminated if the depth $P_{CB}$ of the counter bore 72 is made to be less than the thickness $t_{MF}$ of the mounting flange 57 of the resonator element 58.

The use of a wave washer 78 can alleviate the thermally induced stresses in the resonator 58 by removing some of the thermal stress between the lid 71 and the dielectric material of the resonator elements 58. This makes the overall assembly more suitable for space application.

The use of wave washers 78 instead of bonding processes to secure a resonator element 58 within a cavity 51 provides a significant assembly process advantage and eliminates the incidence of performance variations due to variations in bond thickness.

The above-described mounting arrangement has a very small impact on the Q factor of the resonator cavity 50, since the resonator element 58 is mounted within the cavity 51 through the mounting flange 57 at the electromagnetic field minima. As shown in FIGS. 7A and 7B, the electromagnetic field minima is guaranteed by design to be located at the midpoint of the length of the resonator element 58 through careful optimization of the dimension and shape of the resonator element 58 and cavity 51. Accordingly, the electromagnetic field pattern repeats itself twice along the length of the resonator cavity 50 without comprising the spurious-free range, and allowing for a very high Q factor. This particular mounting structure is applicable to support a plurality of resonant modes and results in lower filter mass and size reduction.

Power that is dissipated inside the dielectric material of the resonator element 58 increases with temperature. In the absence of proper thermal management, this can in turn increase RF losses that lead to further increases in temperature, resulting in a run-away effect. The above-noted mounting configuration provides superior power handling capability when compared with prior art mounting techniques such as that shown in FIG. 4 where the resonator element is mounted on a support. The superior power handling capability of the resonator element 58 is due to the fact that less power is dissipated inside the dielectric material of the resonator element 58, together with less energy stored in the dielectric resonator (FIG. 7B) and the good thermal path provided between the resonator element 58 and the enclosure 72 and the lid 71 at the end walls of the counter bore 73 located at the approximate midpoint of the length of the resonator element 58.

As discussed, in this case where the electromagnetic field pattern repeats itself twice along the length of the resonator element 58, the electromagnetic field exhibits a local minima within the resonator assembly 70 at the approximate midpoint of the length of the resonator element 58 where the mounting flange 57 is used to couple the resonator element 58 to the enclosure 72. This minima of the electromagnetic field extends in a plane that is orthogonal to the longitudinal axis A (FIG. 5) of the cavity 51. This electromagnetic field characteristic offers an opportunity to maximize the quality factor Q for the microwave filter assembly 70 without compromising the ability to transfer heat away from the resonator elements 58 to the cavities 51, the enclosure 72 and the lid 71.

Specifically, since the circumferential region of physical contact between the mounting flange 57 and the sidewall of the cavity 51 is in the same plane as the minima of the electromagnetic field discussed above (i.e. extending in a plane that is orthogonal to the longitudinal axis A (FIG. 5) at the approximate midpoint of the length of the resonator element 58), the Q factor is not degraded by the heat transfer from the resonator element 58 that occurs along this circumferential region. It should be understood that other methods can be used to fix the dielectric resonator element 58 to the aforementioned desirable circumferential region of the sidewall, such as the usage of a resilient epoxy or other known mechanical spring/wave washers.

It should be understood that the concept of using low dielectric constant materials for the resonator element 58 and the mounting support such as the spring element 78, cannot be directly applied to prior art mounting assemblies (FIGS. 1 to 4) because doing so will result in size increase and generation of spurious modes. The presently described configuration is suited for application using low dielectric constant material.

Figure 11:
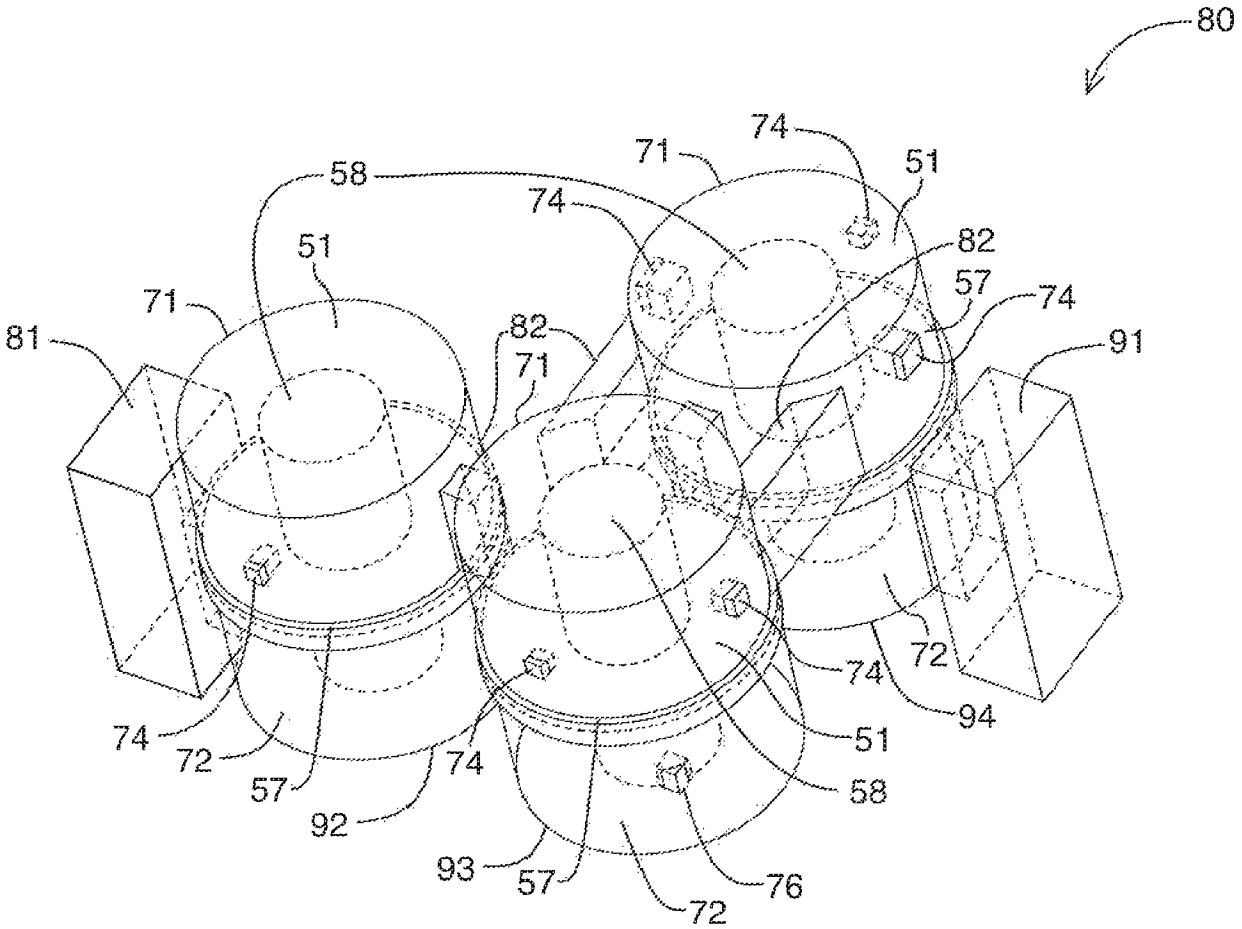
FIG. 11 is a top perspective view of an exemplary filter assembly comprising three of the resonator assemblies of FIG. 8.

FIG. 11 illustrates a filter assembly 80 that includes three resonator assemblies 92, 93 and 94 of the configuration shown in FIG. 8, an input port 81 and an output port 91. Each of the resonator assemblies 92, 93 and 94 include a dielectric resonator element 58 made of a material that has a relatively low dielectric constant (e.g. less than 20), a large Q factor, and may have a small coefficient of resonant frequency variation as a function of temperature.

As described above, each resonator element 58 is mounted to the corresponding resonator cavity 51 though a mounting flange 57. Coupling between two resonator assemblies can be achieved through the use of irises 82 and/or other known coupling methods such as probes. As conventionally known, irises 82 are slots manufactured on the sidewalls of the enclosure 72 or the lid 71 of each resonator assembly 92, 93 and 94 in order to connect two adjacent resonator assemblies.

In general, more than one iris 82 can be used to couple energy between resonator assemblies and varying the sizes of each iris can vary the amount of energy transfer between the two adjacent resonator assemblies. Probes can be made from metal rod of various different shapes and they can be mounted between the cavities of the resonator assemblies via slots or hole while remaining electrically isolated from the walls of the enclosure. The amount of energy coupled through depends from the depth of protrusion into each cavity.

One or two resonator assemblies, typically the first (inlet) and/or the last (outlet), are characterized from an input port 81 or output port 91, which allow the electromagnetic energy to flow in and out of filter assembly 80. Input and output ports 81, 91 can be realized by any known coupling means to couple a resonator assembly to an external source, such as a probe from a coaxial connector or iris from a waveguide port. Input and output ports 81, 91 can be located within the sidewall, the top end wall, or the bottom end wall of the enclosure 72.

Microwave energy can be coupled from the inlet resonator assembly 92 through the input port 81, to the optional intermediate resonator assemblies 93 via the above mentioned coupling means to the outlet resonator assembly 94 and to an external destination through the output port 80.

In addition, tuning screws 74 and coupling screws 76 are located on the sidewalls of the enclosures 72. A tuning screw 74 protrusion is used for resonant frequency adjustment and coupling screw 76 protrusion is used to generate orthogonal modes and to vary the degree of coupling between the two modes.

In general, tuning screws providing frequency adjustments are aligned orthogonally to each other and with the corresponding modes excited in the resonator assembly, but they may be located in different planes since the electromagnetic field pattern repeats itself at least twice in the resonator assemblies 92, 93 and 94. Typically, tuning screws are located at the maximum point of the electric or magnetic field to maximize their effects. In this case, because the electromagnetic field repeats itself at least twice, the tuning screws can be located in different position on the resonator assembly without sacrificing tuning range. The coupling screw is generally located at a 45 degrees angle between the two excited modes.

Tuning screws can have different dimensions even within the same resonator assembly.

Also, the resonator assemblies of the filter assembly 80 can be arranged in a straight line or in a complete folded canonical structure, in principal there is no limitation on the arrangement of the resonator assemblies 92, 93, 94, as far as performance is concerned.

Finally, various denting or machining techniques can also be applied in order to perturb the electromagnetic field. That is, it is contemplated that small pockets of dielectric material be removed from locations in the resonator element 58 where unwanted spurious modes have stronger electromagnetic field strength while desired modes (i.e. the dominant mode) have relatively weaker electromagnetic field strength. As a result, the undesirable spurious modes will resonate either at higher frequency or be removed. Typical approaches of removing dielectric material include cutting and drilling holes in the resonator element 58 as is conventionally known.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto.

The invention claimed is:

1. A resonator cavity for supporting a plurality of resonant modes and filtering electromagnetic energy, said resonator cavity comprising:

(a) a cavity defined by a top end wall, a bottom end wall and a cylindrical sidewall, said cavity having a longitudinal axis along which a length of the cavity is defined; and (b) a resonator element having:

(i) a cylindrical body defined by a top end and a bottom end, said cylindrical body positioned within the cavity along the longitudinal axis of the cavity along which a length of the resonator element is also defined; and (ii) a mounting flange formed in the resonator element around the cylindrical body at the bottom end of the cylindrical body and coupled to the bottom end wall of the cavity;

wherein a complete bottom surface of the resonator element, including a bottom surface of the cylindrical body and a bottom surface of the mounting flange, is coupled to the bottom end wall of the cavity to provide a thermal path between the resonator element and the cavity for heat dissipation;

wherein the cavity and the resonator element have dimensions selected so that the electromagnetic energy associated with the resonator cavity is defined by an electromagnetic field pattern that substantially repeats itself twice along the length of the resonator element.

2. The resonator cavity of claim 1, wherein the mounting flange is an annular extension.

3. The resonator cavity of claim 1, wherein the resonator element is only in physical contact with the cavity through the bottom surface of the cylindrical body and the bottom surface of the mounting flange at the bottom end wall where at least one resonant mode of the electromagnetic energy exhibits a local minimum.

4. The resonator cavity of claim 3, wherein the local minimum is resident within a plane that is orthogonal to the longitudinal axis of the cavity.

5. The resonator cavity of claim 1, further comprising a clamping collar positioned over an outer portion of the mounting flange and secured to the bottom end wall of the cavity.

6. The resonator cavity of claim 5, further comprising a spring mechanism positioned between the clamping collar and an outer portion of the mounting flange that, when the clamping collar is secured to the bottom end wall of the cavity, is caused to exert a deflection pressure onto the outer portion of the mounting flange to secure the resonator element in place within the cavity.

7. The resonator cavity of claim 5, wherein the clamping collar is made of metal.

8. The resonator cavity of claim 5, wherein the clamping collar is made of a dielectric material.

9. The resonator cavity of claim 5, wherein the clamping collar comprises a bottom surface shaped to contact the mounting flange along a contact region and is formed of a material having a spring constant so that the clamping collar, when secured to the bottom end wall of the cavity, is caused to exert a deflection pressure on the mounting flange to secure the resonator element in place within the cavity.

10. The resonator cavity of claim 1, wherein the mounting flange is sloped.

11. The resonator cavity of claim 1, wherein a top space gap is formed between the top end of the resonator element and the top end wall of the cavity.

12. The resonator cavity of claim 1, wherein a dielectric constant of the resonator element is less than 20.

13. The resonator cavity of claim 10, wherein the mounting flange is thicker in a region adjacent to the cylindrical body.

14. The resonator cavity of claim 1, wherein the mounting flange is formed integrally with the cylindrical body.

15. The resonator cavity of claim 1, wherein the mounting flange extends along a portion of a circumference of the cylindrical body.

16. The resonator cavity of claim 15, wherein the cavity is cylindrical.

17. The resonator cavity of claim 1, wherein the mounting flange is coupled to the bottom end wall of the cavity using a mechanism selected from the group consisting of: bonding, clamping, and spring loaded clamping.

18. A resonator cavity for supporting a plurality of resonant modes and filtering electromagnetic energy, said resonator cavity comprising:

(a) a cavity defined by a top end wall, a bottom end wall and a cylindrical sidewall, said cavity having a longitudinal axis along which a length of the cavity is defined; and (b) a resonator element having:

(i) a cylindrical body defined by a top end and a bottom end, said cylindrical body positioned within the cavity along the longitudinal axis of the cavity along which a length of the resonator element is also defined; and (ii) a mounting flange formed in the resonator element around the cylindrical body at the bottom end of the cylindrical body and coupled to the bottom end wall of the cavity;

wherein a complete bottom surface of the resonator element, including a bottom surface of the cylindrical body and a bottom surface of the mounting flange, is coupled to the bottom end wall of the cavity to provide a thermal path between the resonator element and the cavity for heat dissipation;

wherein the cavity and the resonator element have dimensions selected so that the electromagnetic energy associated with the resonator cavity is defined by an electromagnetic field pattern that substantially repeats itself three times along the length of the resonator element.

* * * * *